United States Patent [19]

Van den Aa

[11] 3,963,186

[45] June 15, 1976

[54] TAPE WINDER APPARATUS

[75] Inventor: Hendrik Van den Aa, Pierrefonds, Canada

[73] Assignee: Movatex Products Ltd., Montreal, Canada

[22] Filed: May 15, 1974

[21] Appl. No.: 470,311

[52] U.S. Cl. ..... 242/18 R; 242/35.5 R; 242/158 R; 242/158.4 R; 242/DIG. 2

[51] Int. Cl.[2] ..... B65H 54/04; B65H 54/20; B65H 54/30

[58] Field of Search ..... 242/18 R, 18 CS, 35.5 R, 242/43, 25 R, 45, 158–158.5, DIG. 2

[56] References Cited

UNITED STATES PATENTS

| | | | |
|---|---|---|---|
| 867,298 | 10/1907 | Perry | 242/DIG. 2 |
| 1,186,144 | 6/1916 | Stockamore | 242/158.5 |
| 1,485,425 | 3/1924 | Myette | 242/158.4 R |
| 2,254,221 | 9/1941 | Hubbard | 242/158.4 R X |
| 2,562,733 | 7/1951 | Nelson et al. | 242/158.4 R |
| 3,312,421 | 4/1967 | Kerr et al. | 242/158.4 R |
| 3,491,960 | 1/1970 | Furst | 242/18 R |

FOREIGN PATENTS OR APPLICATIONS

| | | | |
|---|---|---|---|
| 454,362 | 1/1950 | Italy | 242/158.4 R |
| 237,695 | 9/1945 | Switzerland | 242/158.2 |
| 695,515 | 8/1953 | United Kingdom | 242/158.4 R |
| 1,029,653 | 5/1966 | United Kingdom | 242/DIG. 2 |
| 237,695 | 9/1945 | Switzerland | 242/158.2 |

*Primary Examiner*—Stanley N. Gilreath
*Attorney, Agent, or Firm*—McFadden, Fincham & Co.

[57] ABSTRACT

The invention provides an apparatus suitable for helically winding tape from a source thereof, comprising tape receiving means, tape guide means, the said tape receiving means adapted to be rotatably driven by drive means. The guide means are adapted to be reciprocally driven by the drive means in a direction parallel to the axis of rotation of the tape receiving means, and means are provided to vary the linear speed of the guide means relative to the rotational speed of the tape receiving means.

5 Claims, 8 Drawing Figures

TAPE WINDER APPARATUS

This invention relates in general to an apparatus and more particularly, to an apparatus suitable for helically winding tape or ribbon-like material from a source thereof.

Generally, the textile industry is a labour intensive one and there exists a need for more advanced automated equipment. This invention is concerned with the field wherein it is necessary to package tape or a ribbon-like material into convenient packages. The source of the tape may be the machine producing the same, or, alternatively, may comprise previously manufactured tape which is being wound onto smaller spools for more convenient distribution and use. The tape, after it is manufactured is then shipped to end users for the manufacture of garments or the like. Normally, the tape is utilized on sewing machines which are adapted to take the tape from a spool or like storage means.

In winding tape onto a spool, wherein the spool is substantially wider than the tape width, the tape must be wound in a helical manner. In other words, the tape is usually of a relatively narrow width and to wind it solely upon itself would give a very narow spool carrying little tape resulting in extra material costs for spools. Originally, helical winding was done in a manual manner; apparatuses have been developed which will do the helical winding, but generally not in a suitable fashion.

The tape, when being wound upon a spool, is desirably wound in a manner such that the outer layer is substantially smooth and bulges do not build up. Prior art apparatuses have generally not been able to perform this winding in a satisfactory manner as, when the tape is being helically wound and moving from one side of the spool to the other, the last layer at an edge of the spool must have a further layer deposited before starting a traverse. If the above is not done, a crowning effect is achieved wherein the spool will have a crown or bulge at the center after a few layers have been wound. Furthermore, if the apparatus is not adapted to deposit the two layers exactly at the walls of the spool, the tape may "wind up" on the wall of the spool to give a concave effect.

A further problem inherent in prior art apparatuses is that each machine is generally adapted for only one size of tape. It is desirable, as may be appreciated, to have a machine or apparatus which is capable of winding tapes of various widths or varying the amount of overlapment. The term overlapment merely refers to the fact that tape, when wound on the spool, is deposited such that a portion of each "roll" overlaps the previously laid roll. In other words, if the tape is, for example, 5 inches wide, the guide means may only traverse a distance of 1 inch during each rotation of the spool whereby the tape is in effect overlapped with previously laid tape. Prior art apparatuses generally can only vary the amount of the overlapment with a change of gearing within the apparatus. This, of course, can involve substantial downtime, parts inventory, and related expense.

Furthermore, prior art apparatuses are generally limited to the width of spool which they can accept. This is generally due to the arrangement for reciprocating movement.

It is therefore an object of this invention to provide an apparatus suitable for helically winding tape from a source thereof which gives a smoothly wound roll with no crowning or concave effect.

A further object of this invention is to provide an apparatus for helically winding tape, the apparatus being capable of varying the amount of overlapment between adjacent rows of tape.

A still further object of this invention is to provide an apparatus suitable for helically winding tape, the apparatus being capable of performing many such operations simultaneously and being adapted for modular addition.

An even further object of the present invention is to provide an apparatus suitable for helically winding tape, which apparatus is not limited to any particular spool width.

According to one aspect of the present invention, in an apparatus suitable for helically winding tape from a source thereof, the improvement comprising tape receiving means, tape guide means, said tape receiving means adapted to be rotatably driven by drive means, said guide means being adapted to be reciprocally driven by the drive means in a direction parallel to the axis of rotation of said tape receiving means, and means adapted to vary the linear speed of said guide means relative to the rotational speed of said tape receiving means.

In a preferred embodiment, the apparatus comprises at least one spindle, at least one spool releasably mounted on said spindle, said spindle operatively associated with drive means and being adapted to be rotatably driven by said drive means, guide means and clutch means, said guide means adapted to be linearly and reciprocally driven through said clutch means in directions parallel to the axis of rotation of said spindle, and variable pitch pulley means adapted to vary the linear speed at which said guide means are driven with respect to the rotational speed of said spindle.

In the disclosure and claims of the instant application, it will be understood that the tape to be helically wound refers to any ribbon-like material from any suitable source. Thus, as mentioned above, the tape may be wound upon a spool directly after the manufacture of the tape, or alternatively, the tape may be rewound from a larger package to a smaller one.

In greater detail, the tape receiving means according to the present invention comprises any suitable means adapted to form a roll of helically wound tape. Thus, as mentioned above, the tape may be wound upon a spool, roll, core, or directly onto a spindle. Conventionally, the tape will be wound upon a suitable spool mounted on spindle means which are rotatably driven by drive means. Utilizing the apparatus of the present invention, a plurality of spindle means and spool means may be operated from a single drive means leading to greater economy of operation.

The guide means are adapted to guide the tape from its source to the spool means. As such, any suitable guide means may be employed and may vary between relatively simple guide means such as a pair of opposed uprights to such guide means as are shown in U.S. Pat. No. 3,598,337 issued to Mackie on Aug. 10, 1971. There are many such guide means, well known to those skilled in the art which may be utilized with the apparatus of the present invention.

In order to helically wind the tape, there are provided guide mounting means adapted to support the aforesaid guide means and move them in a transverse direction relative to the spool means. These guide mounting means are adapted to move in a reciprocal manner such that the guide means mounted thereupon will guide the tape to the spool means in a helical manner.

The drive means are adapted to rotatably drive the windup means (e.g., spool means and spindle means), and at the same time, transversely drive the guide mounting means as aforementioned. Any suitable drive means may be utilized with the apparatus of the present invention such as, for example, electric motors.

In one aspect of the present invention, the apparatus includes means for adjusting the speed of the transversely driven guide mounting means relative to the rotational speed of the windup means thereby allowing the amount of overlapment of adjacent rows of the helically wound tape to be varied and adjusted. In one embodiment, said means comprises variable pitch pulley means.

As aforementioned, the drive means of the present invention are adapted to rotatably drive the tape receiving means. In one embodiment, the drive means may rotatably drive a first shaft which is suitably interconnected to the tape receiving means thereby rotatably driving the latter. As such, the first shaft may be driven directly through the drive means or alternatively, a suitable pulley and/or gear arrangement be employed. The first shaft may be directly connected to the tape receiving means or one or more gear arrangements may be employed in interconnecting the first shaft to the tape receiving means. Such arrangements may include reducing gears or the like to drive the tape receiving means at a desired rotational speed.

In the above embodiment of the present invention, the first shaft is interconnected to a second shaft which, through a clutch arrangement to be discussed hereinafter, will drive the guide mounting means in a reciprocal manner. It is a feature of the present invention that the means interconnecting said first and second shafts, includes means for varying the rotational speed of one shaft relative to the rotational speed of the other shaft, which, as aforementioned, may comprise variable pitch pulley means.

The variable pitch pulley means comprises a pulley mounted on each of the first and second shafts in an opposed spaced apart relationship to each other with a conventional pulley belt extending therebetween. Each of the pulleys comprises a pair of members which are movable with respect to each other and which have outwardly tapering inner walls. The members thus define a substantially V-shaped channel between the pulley members.

Each of the pulleys has one member thereof held in a fixed position on its shaft. The other member associated with the fixed member is axially movable along the length of the shaft. One of the shafts has spring means associated therewith, the spring means being journalled against the movable member thereby forcing the movable member towards the fixed member. The movable member on the other shaft is manually adjustable with respect to the distance it is spaced apart from the fixed member.

In one mode of operation, the manually adjustable member is spaced apart from its mating fixed member and a suitable V-belt extending between the pair of pulleys "rides" substantially directly on the shaft. At the other pulley, the spring means forces the movable member to a juxtaposed relationship with the fixed member whereby the belt is forced to the outer circumferential limit of the V-shaped channel therebetween.

Assuming the spring loaded pulley is mounted on the driving shaft, the other shaft will be driven at a greater speed than the driving shaft.

When it is desired to change the relative rotational speed of the shafts, the manually adjustable member is moved towards its corresponding fixed member forcing the belt from a position proximate the shaft to a position towards the circumference of the V-shaped channel. By so doing, the belt overcomes the tension of the spring loaded pulley and is pulled in an inward direction towards its shaft. Thus, the relative rotational speed of the two shafts may be varied as desired.

In a further aspect of the apparatus, clutch means are provided, said clutch means allowing reciprocating movement of the transversely moving guide mounting means. Basically, the clutch means includes what may be termed "switching means" on the second rotatably driven shaft, the switching means being rotatably driven by the shaft and being adapted for axial movement therealong.

In accordance with one aspect of the above clutch means, there is provided a pair of opposed bevel gears mounted on the second shaft on either side of the switching means, but not being rotatably driven thereby. In other words, the rotatable shaft drives the switching means but not the pair of opposed bevel gears. The switching means, as mentioned above, are adapted for axial movement along the shaft and may be placed in juxtaposition to either of the aforesaid bevel gears. The switching means drive the bevel gear to which it is juxtaposed and, to this end, there are means on the bevel gears and/or switching means whereby a positive engagement between the bevel gear and switching means may be had. One embodiment includes dogs on the sides of the switching means and bevel gears.

Operatively associated with the aforesaid pair of opposed bevel gears is a third bevel gear adapted to drive the guide mounting means. The third bevel gear is in an operative relationship with both of the aforesiad pair of opposed bevel gears and may be driven by either one of the same. When driven by one of said opposed bevel gears, the third bevel gear will rotate in a first direction; when driven by the other of the pair of bevel gears, the third bevel gear will rotate in a second direction opposed to the first direction.

The third bevel gear is operatively connected to the guide mounting means and is adapted to transversely drive the same. The third bevel gear may be directly connected to the guide mounting means, alternatively, there may be associated with the third bevel gear further gear means such as rack and pinion gears adapted to augment or diminish the speed thereof. Such means are well known to those skilled in the art, and suitable gear ratios may be employed depending upon the final result desired.

For reciprocating movement of the guide mounting means, there may be provided suitable means of alternating the switching means between one or the other of the opposed pair of bevel gears. Such means, in one aspect, may comprise solenoid means. In this respect, switch means operatively associated with the guide mounting means may be employed, such that, when the guide mounting means have reached the end of one transverse movement whereby the tape is at the outer edge of the spool means, the switch means are activated and, via the solenoid means, the switching means are moved from driving one bevel gear to driving the second bevel gear. In the above arrangement, the guide mounting means may include adjustable means thereon adapted to adjust the length of transverse movement of the guide means.

In operation, initially a first layer of helically wound tape is deposited upon the tape receiving means. As the tape reaches the end of the spool, a first layer is wound at the edge thereof and, in order to avoid the crowning effect, a further layer must be deposited in exactly the same position as the preceding layer. With the apparatus of the present invention, the lugs on the pair of opposed bevel gears and the switching means intermediate the bevel gears are mounted such that after switching from one bevel gear to the second bevel gear, the switching means does not commence to drive the second bevel gear until one rotation of the switching means. Thus, while the switching means is not driving either of the bevel gears, the spool means are rotating and the second layer of tape is deposited upon the previously deposited first layer at the edge of the spool.

Naturally, suitable housings for the components contained in the apparatus of the present invention may be provided. Similarly, materials from which the various components of the apparatus are manufactured may be chosen from those suitable and well known to those skilled in the art to which it appertains.

Having thus generally described the invention, reference will be made to the accompanying drawings, illustrating preferred embodiments thereof, and in which.

Figure 1:
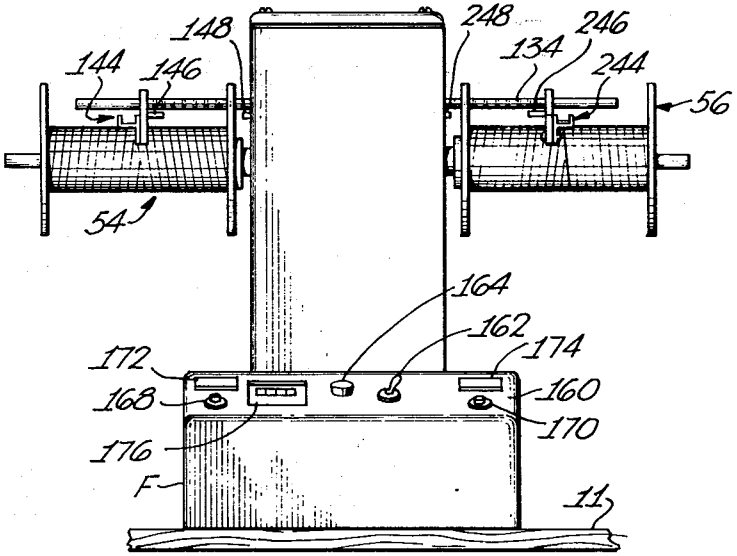
FIG. 1 is a front elevational view of one embodiment of the apparatus according to the present invention.

Referring to the drawings in greater detail and by reference characters thereto, the apparatus illustrated in FIG. 1 includes a suitable frame generally designated by reference numeral F mounted on a supporting surface 11.

As shown, the apparatus includes drive means comprising an electric motor 10 adapted to rotatably drive shaft 12 upon which is mounted pulley 14. It may be noted that base 18 of frame F and supporting surface 11 have an aligned aperture 20 therein through which a belt 22 connected to pulley 14 passes. A plurality of suitable mounting means such as screws 24 are utilized to hold electric motor 10 on supporting surface 11.

Mounted on the lower part of frame F by screws 26 are a pair of opposed shaft mounts 28 and 29. Opposed shaft mounts 28 and 29 are adapted to journal a shaft 30 mounted therebetween. Shaft 30 has a further pulley 32 mounted in alignment with pulley 14 and aperture 20 whereby belt 22 extends between pulleys 14 and 32. Pulley 32 is fixedly mounted on shaft 30 by means (not shown) whereby the shaft is rotatably driven by motor 10.

Mounted on the shaft 30 in a spaced apart relationship to pulley 32 is chain gear 34 which includes a collar 36 having an aperture adapted to receive screw 38 whereby collar 36 may be securely mounted on shaft 30. Chain gear 34 has associated therewith and driven thereby a suitable chain 40.

A chain gear 42 having collar 44 and securing screw 46 is securely mounted on shaft 48. In a manner similar to that described with respect to chain gear 34, chain gear 42 is mounted on shaft 48 such that when gear 42 is driven by chain 40, shaft 48 will rotate therewith. Shaft 48 extends through either side of frame F and is held at one end thereof by mounting member 50 bolted by bolts 52 to frame F. Shaft 48 is adapted to mount the tape receiving means; any number of such tape receiving means may be employed, reference herein will be made to only one side of the apparatus, it being understood that the other side is of a similar construction and is designated by reference numerals in the 200's.

Figure 3:
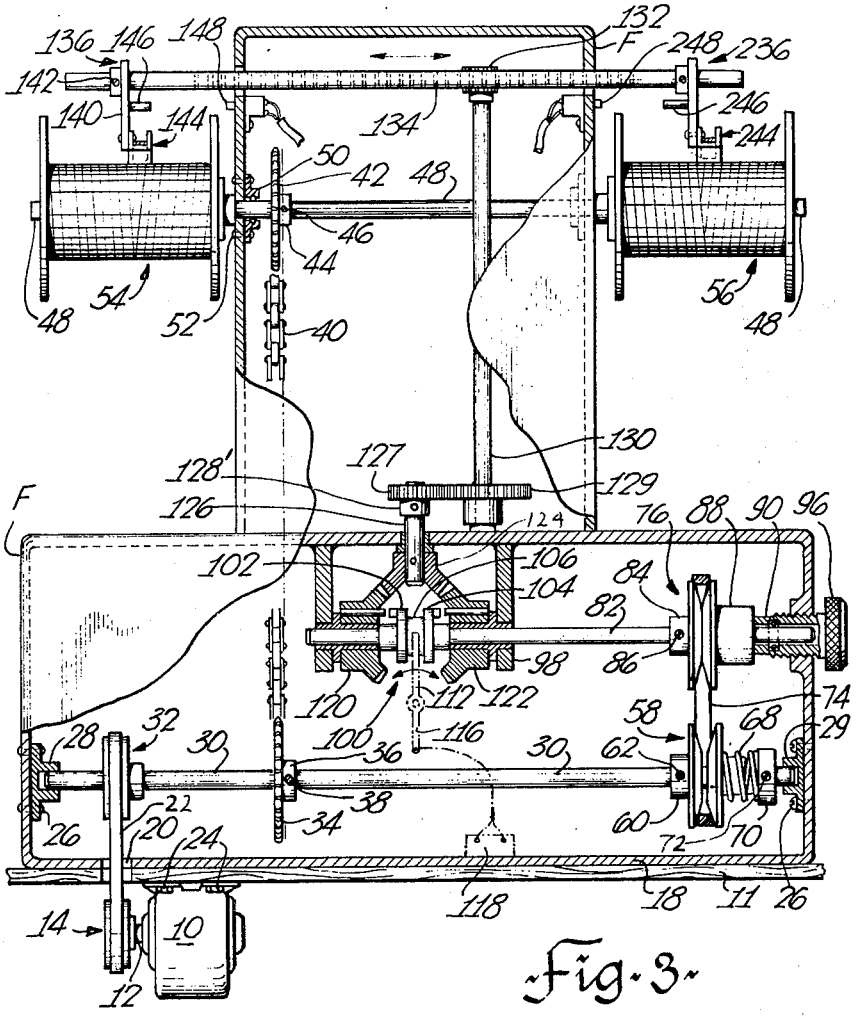
FIG. 3 is a front partial cutaway view of the apparatus of FIGS. 1 and 2 taken along the lines 3—3 of FIG. 2.

As may be seen from FIG. 3, shaft 48 extends in a horizontal manner outwardly of frame F to receive spools 54 and 56. Spools 54 and 56 are retained on shaft 48 by suitable locking members (not shown) well known to those skilled in the art.

It may be noted from FIG. 3 that shaft 30 has, at the end opposed to pulley 32, a further pulley 58. Pulley 58 has associated therewith collar 60 with an aperture adapted to threadedly receive screw 62 whereby pulley 58 is secured to shaft 30.

Figure 7:
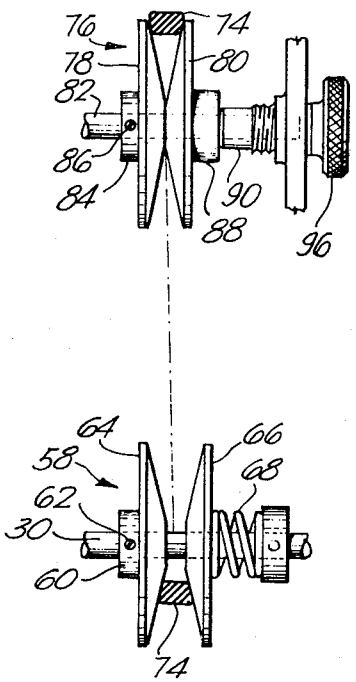
FIG. 7 is a cross sectional view of the variable pitch pulley assembly in a further configuration.
Figure 6:
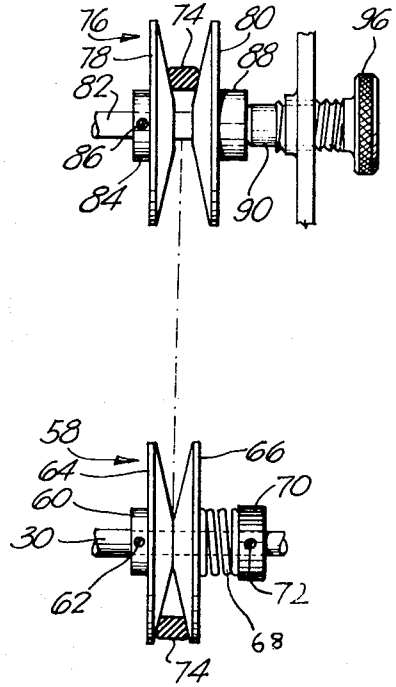
FIG. 6 is a cross sectional view of the variable pitch pulley assembly in one configuration.

Referring to FIGS. 6 and 7, it may be seen that pulley 58 comprises a pair of spaced apart members 64 and 66; member 66 has journalled against one side thereof a spring 68. The other end of spring 68 is journalled against member 70 which by means of a screw 72 is held against shaft 30. Spring 68 normally acts to retain member 66 adjacent member 64, however, member 66 is capable of sliding along shaft 30.

A belt 74 interconnects pulley 58 with a further pulley generally designated by reference numeral 76. In a manner similar to that described with respect to pulley 58, pulley 76 comprises a pair of members 78 and 80 wherein member 78 is held on a shaft 82 by collar 84 having an aperture in which screw 86 is screwthreadedly engaged. In a manner similar to that described with respect to member 66 of pulley 58, member 80 of pulley 76 is axially movable along shaft 82.

As illustrated in FIG. 3, an element 88 is connected to cylinder 90 which is screwthreadedly engaged with frame F and includes a handle 96. By rotation of handle 96, cylinder 90 and element 88 may move member 80 closer to, or away from, fixed pulley member 78.

Figure 5:
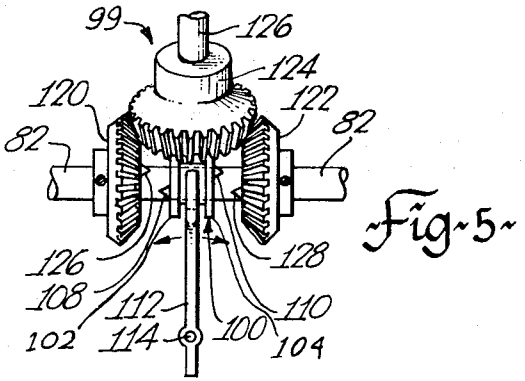
FIG. 5 is a perspective view of the clutch assembly.

The clutch means of the present invention are generally designated by reference numberal 99 and are illustrated in greater detail in FIG. 5. As may be seen, clutch means 99 include so-called switching means 100 having a pair of side walls 102 and 104 with a U-shaped channel generally designated by reference numeral 106 extending therebetween. On the exteriorly facing surfaces of walls 102 and 104 are dogs or lugs 108 and 110 respectively. A U-shaped fork 112 fits within channel 106 as shown in FIG. 5. Fork 112 is pivoted about point 114 with a further member 116 being operatively associated with a pair of solenoids generally designated by reference numeral 118. Solenoids 118 are of a conventional construction and will be discussed in greater detail hereinafter.

Switching means 100 are axially movable along shaft 82 and are moved therealong by means of fork 112. In this respect, switching means 100 are repeatedly driven by shaft 82. This may be accomplished by a tongue (not shown) on shaft 82 leading with a groove (not shown) on switching means 100.

On either side of switching means 100 are bevel gears 120 and 122. A further bevel gear 124 is mounted above member 102 and in operative relationship to bevel gears 120 and 122.

As discussed above, switching means 100 are slidable along shaft 82 and are held adjacent either bevel gear 120 or bevel gear 122 by fork 112. Both bevel gears 120 and 122 have dogs or lugs 126 and 128 respectively. Bevel gear 124 turns a shaft 126 upon which is mounted gear 127 by means of a collar 128'. Gear 127 in turn, rotates gear 129 mounted on shaft 130. In the illustrated embodiment, the ratio of gear 127 to gear 129 is in the order of 1:6; such ratios may be varied according to the end result desired.

Vertically extending shaft 130 has a gear 132 driving guide mounting means 134 through a rack and pinion arrangement. Guide mounting means 134 has a pair of guide means 136 and 236 mounted thereupon. Reference will be made herein to guide means 136; it being understood that guide means 236 are of a substantially identical construction.

Guide means 136, as shown in FIG. 3, are mounted on guide mounting means 134 and comprise a mounting member 140 which is secured to guide mounting means 134 by screw 142. A U-shaped guide channel generally designated by reference numeral 144 is mounted on member 140 and may be removably held on so as to facilitate replacement thereof. Also included on mounting member 140 is an adjustable protrusion 146 which, in the embodiment shown, comprises a screw screwthreadedly engaged with mounting member 140.

Also mounted on frame F and associated with mounting member 140 and positioned so as to be contacted by protrusion 146 is a suitable micro-switch 148.

Figure 2:
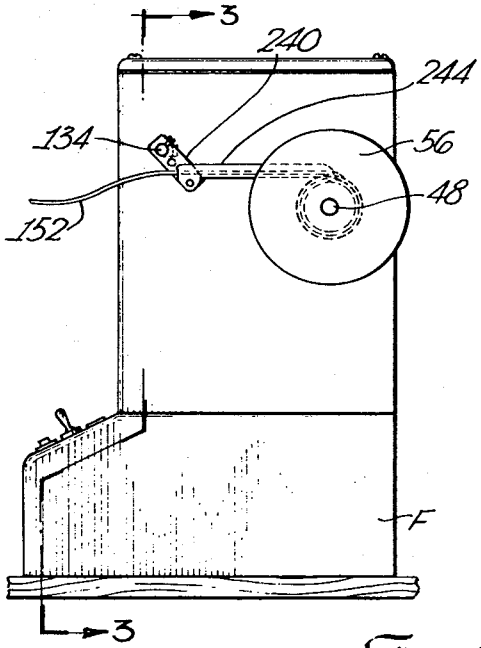
FIG. 2 is a side elevational view of the apparatus of FIG. 1.

As shown in FIG. 2, a tape 152 is taken from a suitable source thereof and threaded through the U-shaped guide channel 244 onto roll 56.

In operation, tape 152 is fed from a source thereof and motor 10 is started. Motor 10 rotates shaft 12 and pulley 14 which, via belt 22, rotates pulley 32 and shaft 30 upon which it is mounted. Chain gear 34 is also rotatably driven and drives chain gear 42 and shaft 48 thereby rotatably driving spools 54 and 56. The tape therefore passes through U-shaped channel 144 and is drawn onto spool 56 by the rotation thereof.

At the same time, pulley 58 is driven by shaft 30 and via belt 74 rotatably drives pulley 76. Pulley 76 in turn drives shaft 82 and switching means 100. Presuming switching means 100 are juxtaposed to bevel gear 120, dog 108 will engage dog 126 thereby rotatably driving bevel gear 120. As aforementioned, bevel gear 124 is operatively associated with bevel gear 120 and will be rotatably driven whereby shaft 130 is driven. Through gears 127 and 129, shaft 130 is rotated linearly driving guide mounting means 134. This will cause guide means 136 to deposit the tape being held by U-shaped channel 144 in a helical manner on spool 54.

When guide means 136 reaches a point proximate to the frame F, protrusion 146 will contact micro-switch 148 which in turn, will activate solenoids 118 whereby fork 112 is shifted to a position away from bevel gear 120 and in juxtaposition to bevel gear 122. For one turn of switching means 100, bevel gear 122 will not be driven as dogs 110 and 128 will not mate. During this time, spool 54 is still being rotatably driven and a further layer of tape will be deposited thereon. After one revolution, dog 110 will meet with dog 128 on bevel gear 122 and rotatably drive the same. As may be seen, the rotation of bevel gear 122 will drive bevel gear 124 in the opposite direction thereby reversing the direction of travel of guide mounting means 134. By so doing, a further layer of tape will be laid on spool 54 with the guide means travelling in the opposite direction. Adjustable protrusions 146 and 246 are capable of fine adjustment such that the apparatus may be set to perform in the above-described manner.

The variable pitch pulley arrangement is best illustrated in FIGS. 6 and 7 and reference will now be made thereto. In one configuration, as shown in FIG. 6, manually adjustable member 80 of pulley 76 is in a spaced apart relationship with respect to member 78. As may be seen, the V-shaped channel between members 78 and 80 is substantially larger than the dimensions of belt 74 whereby belt 74 is allowed to ride on shaft 82.

At the same time, due to the spring pressure of spring 68, member 66 is juxtaposed to member 64 of pulley 58 whereby belt 74 is forced to the outer circumferential edge of the V-shaped channel between members 64 and 66.

In FIG. 7, member 80 has been placed proximate to member 78 on pulley 76 by the aforedescribed means. This forces belt 74 circumferentially outward frm shaft 82 as shown. At the same time, since belt 74 is of a relatively constant circumference, member 66 is forced away from member 64 against spring 68. Belt 74 is therefore proximate or on shaft 30.

As is obvious from the above, the variable pitch pulley arrangement allows an augmentation or diminishing of the rotational speed of shaft 82 with respect to shaft 30. In so doing, the distance travelled by guide mounting means 134 during one rotation of shaft 48 may be varied. This in turn will vary the amount of overlapment of adjacent rows of tape 152.

Figure 4:
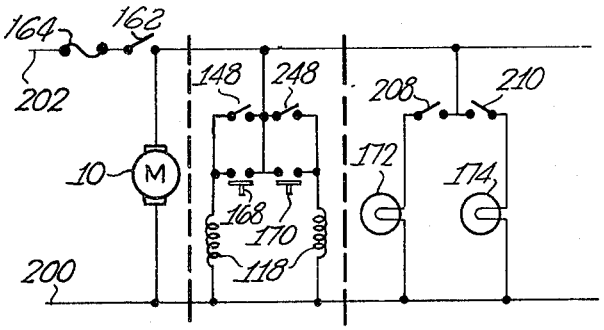
FIG. 4 is a schematic view of the electric circuits of the apparatus of FIGS. 1 to 3.

Referring back to FIG. 1, the present invention includes a control panel generally designated by reference numeral 160. Incorporated in control panel 160 is a master ON-OFF switch 162 and a fuse 164. A pair of pushbuttons 168 and 170 are also included therein, which pushbuttons operate as "override" to reverse the direction of traverse of guide mounting means 134. In other words, pushbuttons 168 and 170 activate solenoids 118 and can reverse the direction of travel of the guide mounting means. A pair of direction indicating lights 172 and 174 are adapted to indicate the direction of traverse of the guide rod. If desired, as shown in FIG. 4, a pair of microswitches 208 and 210 may be mounted so as to be activated by the clutch or switching member to thereby activate indicating lights 172 and 174. Alternatively, lights 172 and 174 may be included in the solenoid circuit. A suitable digital counter indicated generally by reference numeral 176 may be utilized to measure the amount of tape being wound. A suitable source of power may be connected across lines 200 and 202.

Figure 8:
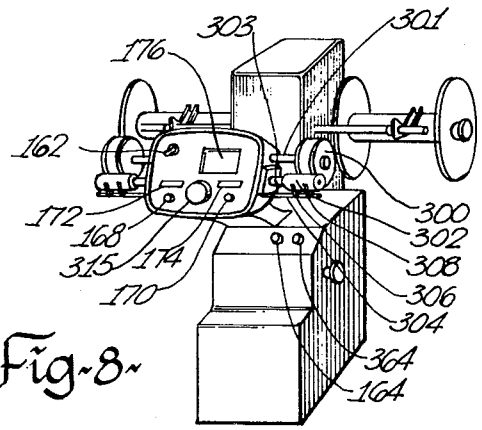
FIG. 8 is a perspective view of a further embodiment of the apparatus of the present invention.

FIG. 8 illustrates a further embodiment of the apparatus of the present invention and reference numerals corresponding to those utilized in describing FIGS. 1 to 7 are employed.

Basically, the embodiment of FIG. 8 employs a pair of rolls 300 and 302 mounted on shafts 301 and 303 respectively. One of the rolls is adapted to measure the amount of tape passing therebetween. For example, roll 300 may have a circumference of 1 foot whereby one complete revolution of the shaft will activate a digital counter indicating 1 foot of tape has passed therebetween. It may be noted that a pair of guide members 306 and 308 mounted on shaft 304 are included. Furthermore, another fuse 364 may be incorporated in the control panel.

Still further, the apparatus may, instead of using a simple electric motor 10, employ a motor with a magnetic clutch. Such motors are commercially available in which case, a torque-speed control generally designated by reference numeral 315 may be incorporated in the control panel. Torque-speed control 315 allows the "dialing" of the torque required.

It will be obvious to those skilled in the art that many changes may be made to the apparatus of the present invention without departing from the spirit and scope thereof. Thus, for example, the direct gearing of shaft 30 to shaft 48 may be changed if desired using suitable standard gearing components. Gearing arrangements to speed up or reduce the rotational speed of one shaft with respect to a further shaft may also be employed. In the above respect, if too great a force is placed on the dogs when initially starting up the machine or reversing directions, a further drive shaft may be utilized to reduce the speed of shaft 82. Furthermore, gearing could be employed after bevel gear 124 to increase or decrease the rotational speed as desired.

As may be seen, the apparatus of the present invention lends itself to a modular approach. In other words, further guide mounting means and tape receiving means may be added on top of those described in FIG. 3. Further tape receiving means and tape guide means could be driven from a common drive means.

Also, as may be seen from the above-described embodiments, there is no limit to the width of a spool which the apparatus is able to accept. This can naturally provide far greater flexibility than in prior art apparatuses.

All such changes and modifications are deemed to be covered by the present invention which is not limited by the above-described embodiments, but rather by the claims appended hereto.

I claim:

1. An apparatus suitable for helically winding a tape, comprising a drive module, said drive module comprising drive means, a first shaft rotatably driven by said drive means, a second shaft, a variable pitch pulley interconnecting said first and second shafts, means on said second shaft for varying the speed at which said second shaft is driven relative to said first shaft, a clutch member mounted on said second shaft and rotatably driven thereby, said clutch member having at least one lug on each side thereof, a pair of bevel gears mounted on said second shaft on either side of said clutch member, said pair of bevel gears each having at least one lug on the sides thereof for engagement with the corresponding lug on said clutch member, whereby said clutch member can rotatably drive one of said bevel gears, means for switching said clutch member to selectively drive one of said bevel gears through engagement of respective lugs, a third bevel gear operatively associated with said pair of bevel gears and being driven thereby, at least one winding module comprising a spool mounting shaft directly and rotatably driven by said first drive shaft, at least one spool mounted on each end of said spool mounting shaft, tape guide means linearly driven by said third bevel gear in a direction parallel to the axis of rotation of said spool mounting shaft, microswitches mounted on either side of a frame of said winding module, and adjustable means on said tape guide means for contacting said microswitches, said microswitches being operatively associated with said means for switching said clutch member between said pair of bevel gears, said adjustable means being adjustable such that when the tape guide means is linearly driven in a first direction by mating engagement of said clutch lug and said lug on said first bevel gear and said microswitch is contacted to reverse the direction of travel of said tape guide means, said clutch means, after being switched by said switching means, rotates through substantially 360° before the lug on said clutch means engages the mating lug on said second bevel gear.

2. The apparatus of claim 1 wherein said means for switching said clutch member comprises solenoid means.

3. The apparatus of claim 2 including a plurality of said winding modules.

4. The apparatus of claim 3 including measurement means, said measurement means comprising a freely rotatable roll over which said tape passes, said roll being operatively connected to a digital counter measuring the number of rotations of said roll.

5. The apparatus of claim 1 wherein said drive means comprises a magnetic clutch motor and a torque speed control associated therewith.

* * * * *